US005166720A

United States Patent [19]

Tanaka

[11] Patent Number: 5,166,720

[45] Date of Patent: Nov. 24, 1992

[54] DENTAL X-RAY FILM DEVELOPING MACHINE

[75] Inventor: Hiroyuki Tanaka, Yokohama, Japan

[73] Assignee: Nix Company Ltd., Tokyo, Japan

[21] Appl. No.: 716,103

[22] Filed: Jun. 17, 1991

[30] Foreign Application Priority Data

Jun. 20, 1990 [JP] Japan ..... 2-159910
Nov. 6, 1990 [JP] Japan ..... 2-298974

[51] Int. Cl.[5] ..... G03D 3/08
[52] U.S. Cl. ..... 354/322
[58] Field of Search ..... 354/322, 299, 330, 316, 354/329, 321, 328

[56] References Cited

U.S. PATENT DOCUMENTS

| | | | |
|---|---|---|---|
| 3,443,503 | 5/1969 | Holm et al. | 354/316 |
| 4,162,841 | 7/1979 | Dragone | 354/316 X |
| 4,397,536 | 8/1983 | Zwettler | 354/322 |
| 4,410,257 | 10/1983 | Thebault | 354/322 X |
| 4,853,729 | 8/1989 | Tanaka | 354/322 |
| 5,005,036 | 4/1991 | Wilson et al. | 354/322 |

FOREIGN PATENT DOCUMENTS 1497420 5/1969 Fed. Rep. of Germany .

1149784 12/1957 France .

*Primary Examiner*—Michael L. Gellner
*Assistant Examiner*—D. Rutledge
*Attorney, Agent, or Firm*—Wegner, Cantor, Mueller & Player

[57] ABSTRACT

A dental X-ray film developing machine is described. The machine has a cylindrical housing, a motor fixed on the housing, an arm for being driven by the motor, and a film holder for being brought into detachable engagement with the arm whereby development processing of a film mounted on the film holder is conducted while the film holder makes a full turn within the housing. Plural tanks, including a tank containing a developer and another tank containing a final processing solution such as water, are removably arranged along a peripheral wall of the housing. A film-holder-inserting portion is located before the developer-containing tank relative to the turning direction of the arm so that the film holder with the film mounted thereon can be positioned at a point where the film holder can be brought into engagement with the arm which is being driven. A device for detaching the film holder from the arm is provided after the final-processing-solution-containing tank relative to the turning direction of the arm.

14 Claims, 13 Drawing Sheets

DENTAL X-RAY FILM DEVELOPING MACHINE

BACKGROUND OF THE INVENTION

1) Field of the Invention

This invention relates to a dental X-ray film developing machine for developing one or more exposed dental X-ray films.

2) Description of the Related Art

X-ray pictures of teeth have been used for the diagnosis and treatment of teeth in recent years. X-ray photography of a tooth for obtaining its X-ray picture is effected by bringing an opaque dental X-ray film pack, which contains an X-ray film sealed therein, into a diseased part within a mouth and then exposing the X-ray film to X-rays through the diseased part. By this X-ray photography, a latent image of the tooth is formed on the X-ray film.

After completion of the X-ray photography, the X-ray film pack is taken out of the mouth and is then opened in a dark room or the like to take out the X-ray film. The X-ray film thus taken out is processed for its development, for example, is developed, fixed and washed, whereby an X-ray picture of the thus-taken tooth is obtained on the X-ray film.

A variety of automatic developing machines has heretofore been proposed in order to perform the above development easily without labor, for example, as described in assignee's U.S. Pat. No. 4,853,729 issued Aug. 1, 1989, the subject matter of which is hereby incorporated by reference. The automatic developing machine of the above U.S. Patent will be described with reference to some of the accompanying drawings.

FIG. 1 is a plan view of the dental X-ray film developing machine. FIG. 2 is a cross-sectional view taken along line II—II of FIG. 1. In these drawings, numeral 1 indicates the developing machine. There are shown a circular bottom wall 2*a*, a cylindrical outer peripheral wall 2*a* provided upright from the peripheral edge of the bottom wall 2*b*, and a cylindrical inner peripheral wall 2*c* provided at a predetermined interval inside the outer peripheral wall 2*b*. An annular and groove-like space is formed by the bottom wall 2*a*, outer peripheral wall 2*b* and inner peripheral wall 2*c*. Designated at symbols 3*a*,3*b*,3*c*,3*d* are partition walls provided radially between the outer peripheral wall 2*b* and inner peripheral wall 2*c*. The individual partition walls 3*a*–3*d* are arranged at predetermined intervals. Owing to the provision of the partition walls 3*a*–3*d*, the annular space is divided in four compartments 4*a*,4*b*,4*c*,4*d*.

Numeral 5 indicates a motor mounted on the bottom wall 2*a* inside a cylindrical space formed by the bottom wall 2*a* and inner peripheral wall 2*c*. The drawings also illustrate a rotary shaft 6 connected to the motor 5 either directly or via a reducing gear unit, not shown, an arm 7 fixed at one end thereof on the rotary shaft 6 and extending radially from the rotary shaft 6, and a suspending portion 7*a* formed in the opposite, namely, free end of the arm 7. The free end, namely, the suspending portion 7*a* of the arm 7 is positioned above the annular space and approximately at midpoint between the outer peripheral wall 2*b* and the inner peripheral wall 2*c*. Designated at symbols 8*a*,8*b*,8*c* are plugs closing their corresponding discharge openings formed through lower parts of the peripheral outer walls 2*b* of the respective compartments 4*a*,4*b*,4*c*. Numeral 10 indicates a holder as a film-mounting member, which is adapted to support a dental X-ray film thereon. The structure of the holder 10 will next be described with reference to FIGS. 3(A) and 3(B) which are a plan view of the holder shown in FIG. 2 and a cross-sectional view taken along line III(B)–III(B) of FIG. 3(A), respectively.

The holder 10 is composed of a stem portion 10*a*, a hole 10*b* formed through one end portion of the stem portion 10*a*, and a film-mounting portion 10*c* formed at the other end portion of the stem portion 10*a*. The film-mounting portion 10*c* is bifurcated as is depicted in FIG. 3(A), and slots 10*d*,10*d* are formed in inner edges of the bifurcated branches, respectively, as is shown in FIG. 3 (B). By inserting both sides of a dental X-ray film F into the corresponding slots 10*d*,10*d* from the free end of the film-mounting portion 10*c*, the dental X-ray film F is supported on the holder 10.

A description will next be made of development processing making use of the developing machine 1 with reference to an operation schematic illustrated in FIG. 4 in which the individual compartments provided in the toroidal arrangement are shown in a manner developed on a planar sheet. Upon development processing, as is illustrated in FIG. 4, the compartments 4*a*,4*b*,4*c* are filled with a developer S1, a fixer S2 and a washing liquid (not shown) respectively, but the compartment 4*d* is left as a space. The exposed X-ray film F is taken out of a dental X-ray film pack and is fitted in the slots 10*d*,10*d* of the holder 10 so as to support the film F. As is illustrated in FIG. 2, the hole 10*b* of the holder 10 is fitted on the hook of the suspending portion 7*a* of the arm 7 so that the holder 10 is suspended from the free end of the arm 7. As will be described subsequently, the arm 7 is set to assume the position shown in FIG. 1, namely, the position close to the partition wall 3*a* of the compartment 4*a*. The dental X-ray film F is therefore immersed in the developer S1 when the holder 10 is suspended initially from the suspending portion 7*a* as described above.

When the motor 5 is driven immediately in the above state, the rotary shaft 6 of the motor 5 rotates so that the free end of the arm 7 starts moving approximately along the angular center line of the compartment 4*a*. As a result, the dental X-ray film F mounted on the film-mounting portion 10*c* of the holder 10 is also caused to move through the developer S1. In the course of this movement, the development of the dental X-ray film F is carried out.

When the dental X-ray film F approaches the partition wall 3*b*, the film-mounting portion 10*c* of the holder 10 is brought into contact with the tilted surface $2a_1$ formed on the bottom wall 2*a* of the compartment 4*a*. As the arm 7 moves, the holder 10 is pivoted upwardly about the suspending portion 7*a* by the tilted surface $2a_1$ and eventually rides on the partition wall 3*b* in a state as indicated by broken lines. When the arm 7 moves further, the film-mounting portion 10*c* moves on the partition wall 3*b* and then rides over the partition wall 3*b*. At this moment, the holder 10 is allowed to pivot downwardly about the suspending portion 7*a*, whereby the film-mounting portion 10*c* is dropped in the fixer S2 in the compartment 4*b* to immerse the dental X-ray film F in the fixer S2. The dental X-ray film F is thereafter caused to move through the fixer S2 to conduct its fixing as the arm 7 moves.

In exactly the same manner, the dental X-ray film F moves into the compartment 4*c* so that the dental X-ray film F enters a washing liquid. While moving through the washing liquid, its washing is conducted. The dental X-ray film F then moves from the compartment 4c into the compartment 4d. While the dental X-ray film F passes through the compartment 4d, any washing liquid still remaining on the surfaces of the dental X-ray film F are allowed to drop.

After the film F has passed through the compartment 4d, the holder 10 is detached from the arm 7 and the dental X-ray film F is removed from the film-mounting portion 10c of the holder 10. The development processing of the dental X-ray film F has now been completed, so that an X-ray picture of a tooth is shown there.

The above developing machine 1 is suitable for easily developing the exposed dental X-ray film F by a dentist or his assistant in his office. Desirably, the developing machine 1 therefore has small overall dimensions and can be handled easily.

With the construction of the above developing machine 1, replacement of the processing solutions requires advance placement of catch pans below the plugs 8a–8c respectively, and, after pulling out the plugs 8a–8c, it is necessary to wait until the processing solutions are discharged completely. The handling of the developing machine is therefore rather cumbersome.

When development processing is performed using the above developing machine 1, a dentist or the like is required to pick up the holder 10, to fit the hole 10b on the suspending portion 7a of the arm 7 and, after completion of the development, to detach the holder 10 from the arm. The developing machine 1 therefore requires substantial labor in its handling. Further, the developing machine 1 requires stopping of the arm 7 after every full turn to detach the holder 10 with the exposed film F from the arm 7 and then to suspend from the arm 7 another holder with an unexposed film mounted thereon. The developing machine 1 cannot therefore be rotated continuously, leading to the drawback that the work efficiency of development processing is poor.

SUMMARY OF THE INVENTION

An object of the present invention is to overcome the above-described problems or drawbacks of the conventional art and to provide a dental X-ray film developing machine which permits easy replacement of processing solutions and automated, continuous development processing.

In one aspect of the present invention, there is thus provided a dental X-ray film developing machine having a cylindrical housing, a motor fixed on the housing, an arm for being driven by the motor, and a film holder for being brought into detachable engagement with the arm whereby development processing of a film mounted on the film holder is conducted while the film holder makes a full turn within the housing. The developing machine comprises a plurality of tanks, a film-holder-inserting portion and a film-holder-detaching means. The tanks are removably arranged along a peripheral wall of the housing. One of the tanks contains a developer, and another one of the tanks contains a final processing solution. The film-holder-inserting portion is located before the developer-containing tank relative to the turning direction of the arm so that the film holder with the film mounted thereon can be positioned at a point where the film holder can be brought into engagement with the arm which is being driven. The film-holder-detaching means serves to detach the film holder from the arm and is located after the final-processing-solution-containing tank relative to the turning direction of the arm.

When the motor is driven, the arm is caused to progressively rotate and, at the film-holder-inserting portion, engages the film holder. The arm continuously rotates with the film holder kept in engagement with the arm, so that the film holder is separated from the film-holder-inserting portion and is held in a state suspended from the arm. As the arm rotates, the film mounted on the film holder successively passes through the developing tank and a fixing tank so that development processing is carried out. When the rotation of the arm proceeds further, the film holder is brought into contact with the film-holder-detaching means and is detached from the arm, whereby the film holder drops onto a predetermined position. When the processing solutions have been deteriorated and their replacement by fresh ones is needed, the tanks are removed and tanks containing fresh processing solutions, respectively, are placed instead.

The dental X-ray film developing machine according to the present invention permits automated attachment and detachment of the film holder to and from the arm which is rotating and moving. The labor and time required for the attachment and detachment can therefore be obviated. In addition, the handling has been much simplified. Since the attachment and detachment of the film holder can be automatically conducted in a continuous manner as mentioned above, it is no longer necessary to stop the rotation of the arm for the attachment and detachment of the film holder so that the work efficiency of developing processing can be improved. Further, the removable arrangement of the tanks in the housing can facilitate replacement of processing solutions.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENTS

Figure 5:
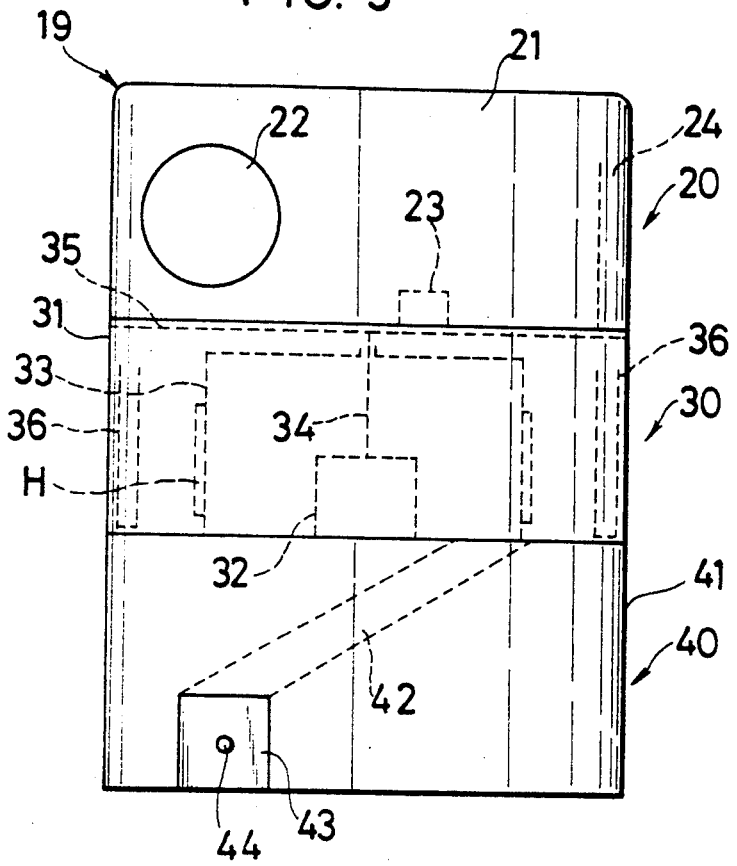
FIG. 5 is a side view of a dental X-ray film developing machine according to a first embodiment of the present invention.
Figure 6:
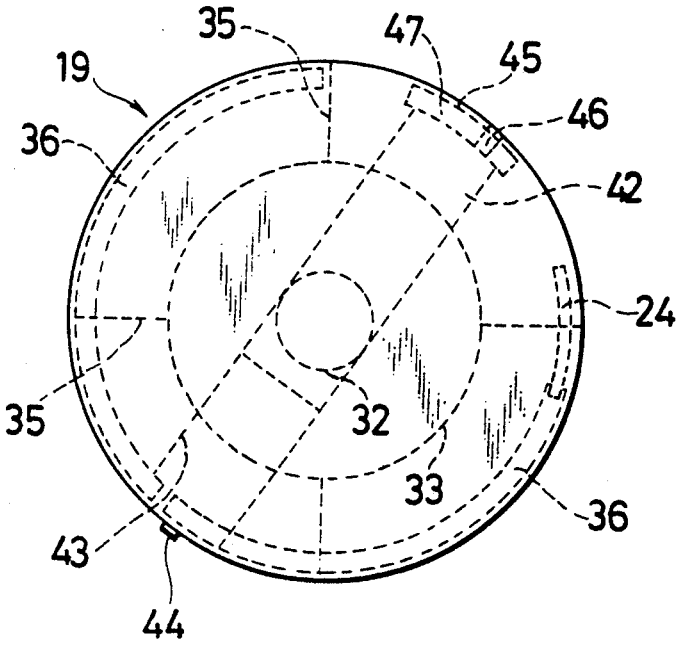
FIG. 6 is a plan view of the developing machine of FIG. 5.

Referring first to FIGS. 5 and 6, the dental X-ray film developing machine according to the first embodiment of the present invention will be described. In each of these drawings, numeral 19 indicates the developing machine. There are also shown a film-mounting and placing portion 20, a development processing portion 30 and a take-out portion 40, all of which have a cylindrical shape. The film-mounting and placing portion 20 is formed of a housing 22*a*1, and includes two holes 22 opened in the housing 21, a film-mounting stage 23 and a film-placing opening 24. It is to be noted that only one of the holes 22 is visible in FIG. 5 and the other hole is formed on an opposite side and is hence not visible in FIG. 5. The development processing portion 30 is formed of a housing 31 and includes a motor 32, a motor cover 33, a motor shaft 34, an arm 35 connected to the motor shaft 34 and tanks 36. Further, the take-out portion is formed of a housing 41, and includes a film transfer path 42 and a box 43 having a handle 442. Designated at numerals 45, 46 and 47 are a film-holder-detaching portion, a detaching projection, and an opening of the film transfer path 42, respectively. Incidentally, letter H indicates a heater pad fixed on the motor cover 33.

Details of the construction of each tank in the first embodiment shown in FIGS. 5 and 6 will be described first with reference to FIGS. 7, 8 and 9, in which numeral 36 indicates the tank. The tank contains a developer, a fixer, a washing liquid or the like (a developer $S_1$ in FIG. 8). Designated at numeral 361 is a cover film closing an opening of the tank 36. The cover film is peelably bonded to an upper face of an edge of the opening. Symbols 361*a*,361*b* indicate tabs formed at both ends of the cover film 361 to facilitate its peeling.

Figure 7:
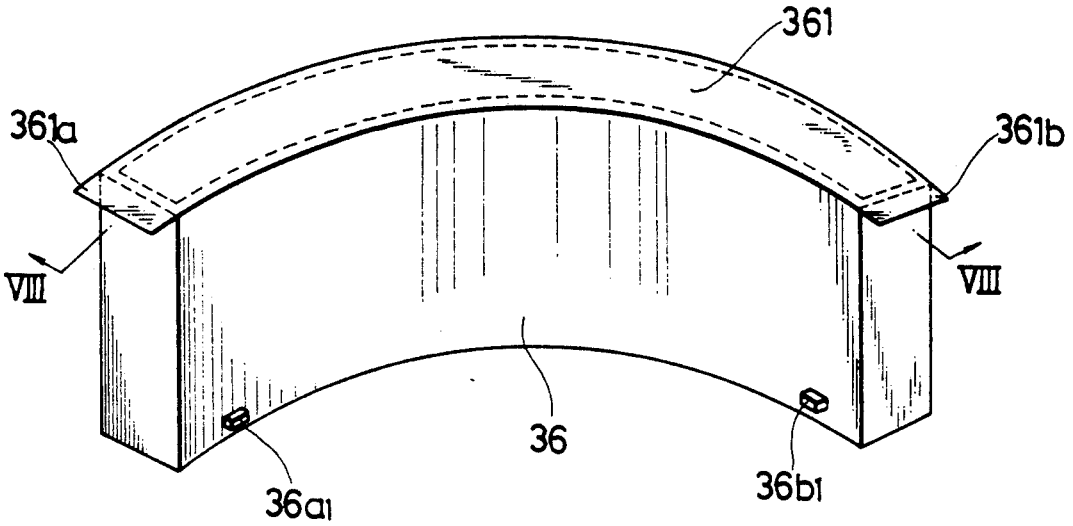
FIG. 7 is a perspective view of one of tanks shown in FIG. 6.
Figure 8:
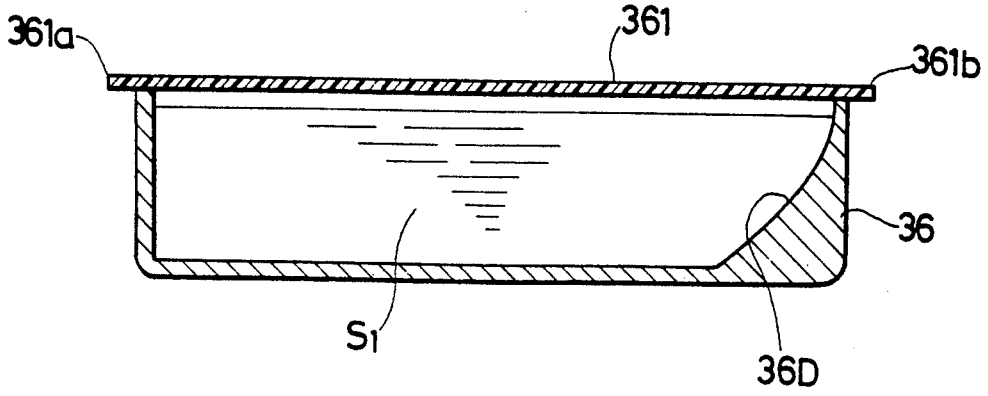
FIG. 8 is a cross-sectional view taken along line VIII—VIII of FIG. 7.

As is apparent from FIG. 7, the tank 36 is constructed in a curved shape. The radius of curvature of the tank substantially conforms with that of the housing 31. As is illustrated in FIG. 9, the width W of the tank 36 is set at a dimension much smaller compared with the depth d of the tank 36. Further, designated at numerals 311 and 32*a*12 in FIG. 9 are a bottom wall of the housing 31 and a tank-fixing, upright wall extending upright from the bottom wall 311, respectively. In FIG. 7, symbols $36a_1$,$36b_1$ are lugs which are provided on lower parts of the tank 36 and are used to fix the tank 36. As is clearly envisaged from FIG. 9, similar lugs are provided on an opposite wall of the tank 36. As will be described subsequently, owing to the provision of these lugs, insertion of the tank 36 between the housing 31 and the upright wall 312 makes it possible to fix the tank 36 in a state anchored on the housing 31 as shown in FIGS. 5 and 6. When a need arises for the replacement of the processing solution during the use, it is only necessary to take out the tank 36, to fix another tank with fresh processing solution filled therein, to hold the tab 361*a* or 361*b* of the cover film 361 of the latter tank, and then to peel off the cover film to expose the processing solution.

Figure 10:
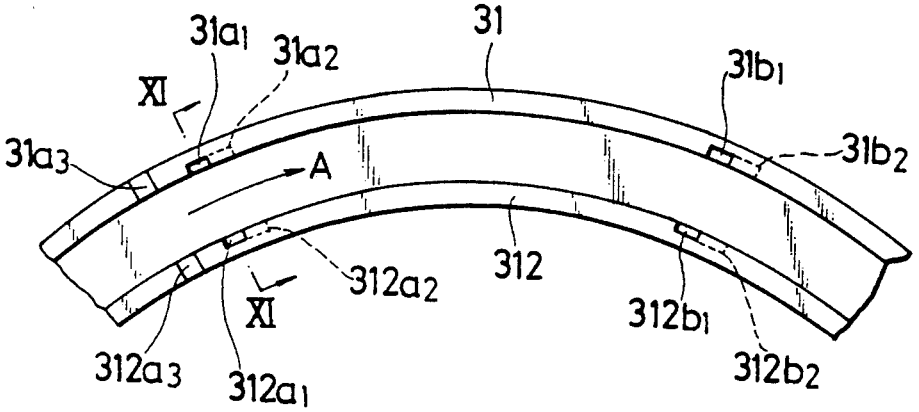
FIG. 10 is a plan view of fixing portions of the tank of FIG. 7.
Figure 11:
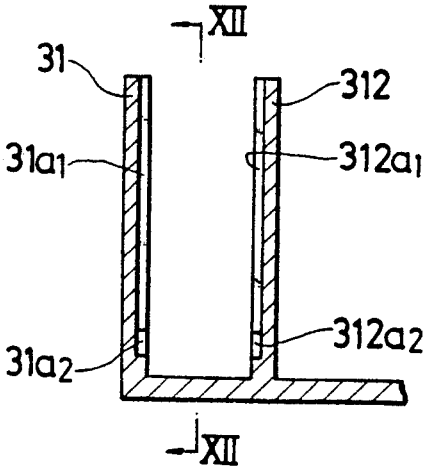
FIG. 11 is a cross-sectional view taken along line XI—XI of FIG. 10.

The fixing mechanism for the tank 36 will next be described with reference to FIGS. 10 to 12, in which numerals 31, 311 and 312 indicate the above-described housing, bottom wall and upright wall, respectively.

Figure 12:
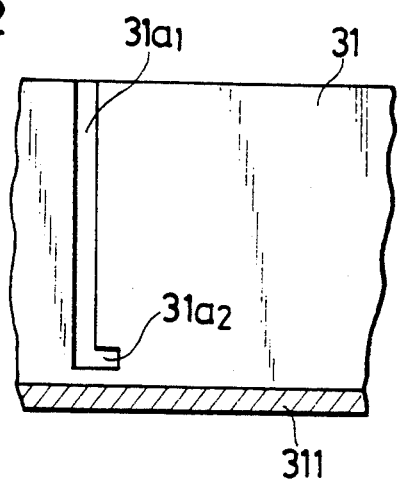
FIG. 12 is a cross-sectional view taken along line XI—XII of FIG. 10.

Designated at symbols $31a_1$,$31b_1$ are vertical grooves formed in an inner wall of the housing 31, while symbols $31a_2$,$31b_2$ indicate horizontal grooves which, as is illustrated in FIG. 12, are formed in continuation with the vertical grooves $31a_1$,$31b_1$ and extend at right angles relative to the vertical grooves $31a_1$,$31b_1$, respectively. Similarly, symbols $312a_1$,$312b_1$ designate vertical grooves formed in an inner surface (as viewed from the side of the tank) of the upright wall 312 while symbols $312a_2$,$312b_2$ indicate horizontal grooves formed at right angles relative to the vertical grooves $312a_1$,$312b_1$, respectively. Designated at symbols $31a_3$,$312a_3$ are holding slot formed in upper edges of the housing 31 and the upright wall 312.

To fix the tank 36, the tank 36 is inserted between the housing 31 and the upright wall 312 while the four lugs of the tank 36 are maintained in engagement with their corresponding vertical grooves $31a_1$, $31b_1$, $312a_1$, $312b_1$. When the tank 36 has reached the bottom, the tank 36 is pushed in the direction of arrow A in FIG. 10 so that the respective lugs are caused to enter their corresponding horizontal grooves $31a_2$,$31b_2$, $312a_2$,$312b_2$. This state is shown in cross-section in FIG. 9. A suitable holding rod (not shown) is finally fitted in the holding slots $31a_3$,$312a_3$, whereby the tank 36 is prevented from moving in a direction opposite to arrow A and is hence arranged in a state fixed at the exact position. After the tank 36 has been positioned and fixed as described above, the cover film 361 is pulled upwards at either one of the tabs so that the cover film 361 is peeled off from the tank 36. As a result, the processing solution in the tank 36 is exposed to permit entry of the film holder therein. Removal of the tank 36 is carried out by an operation opposite to the above-described fixing operation.

Figure 9:
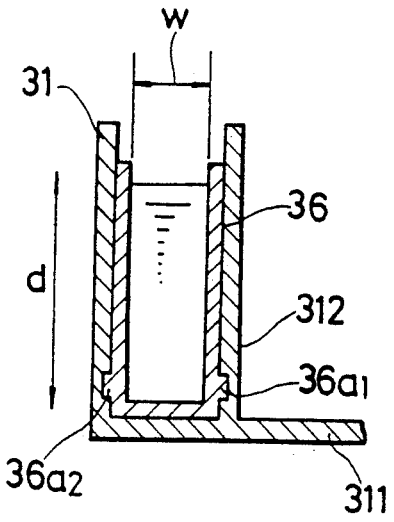
FIG. 9 is a cross-sectional view of the tank of FIG. 7, in which the tank is in a state fixed in the developing machine.
Figure 13:
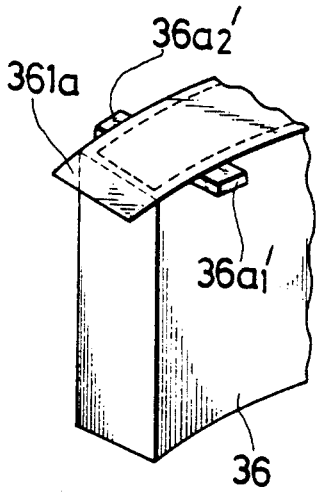
FIG. 13 is a fragmentary perspective view of another specific example of the tank shown in FIGS. 5 and 6.
Figure 14:
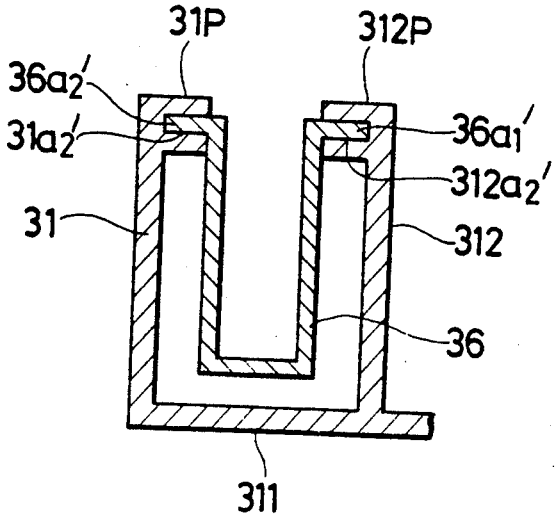
FIG. 14 is a cross-sectional view of the tank of FIG. 13.

FIGS. 13 and 14 illustrates another specific example of the tank fixing mechanism, in which elements either identical or equivalent to certain elements shown in FIGS. 7 and 9 are identified by like reference numerals or symbols and their description is omitted herein. Further, in FIGS. 13 and 14, elements corresponding to certain elements shown in FIGS. 7 and 9 are identified by like reference numerals or symbols plus a prime (').

Designated at symbols 36$a_1$',36$a_2$' are lugs. Unlike the lugs 36$a_1$,36$a_2$ in the above example, These lugs 36$a_1$',-36$a_2$' are provided on upper parts of the tank 36. Symbols 31P,312P are flanges formed on upper ends of the housing 31 and upright wall 32*a*12, respectively. Symbols 31$a_2$',312$a_2$' designate horizontal grooves defined by the flanges 31P,312P, respectively. Although not shown in the drawings, each of the flanges 31P,312P defines similar vertical grooves to those depicted in FIGS. 10–12.

The specific example shown in FIGS. 13–14 is different from the preceding example only in that the lugs 36$a_1$',36$a_2$' are formed the lower parts of the tank 36 and the vertical grooves and horizontal grooves are not directly formed in the housing 31 and the upright wall 312 but are formed in the flanges 31P,312P on their upper ends. By the flanges 31P,312P, the tank 36 is kept suspended from the flanges 31P,312P when arranged and fixed in the developing machine. The manner of arrangement and fixing of the tank in this specific example is the same as the preceding example so that its description is omitted.

Figure 1:
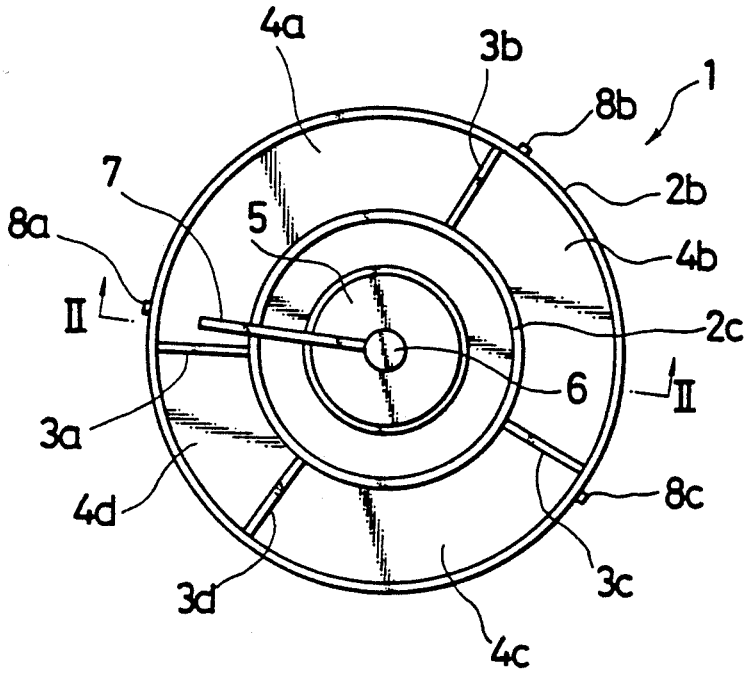
FIG. 1 is a plan view of a conventional developing machine.
Figure 2:
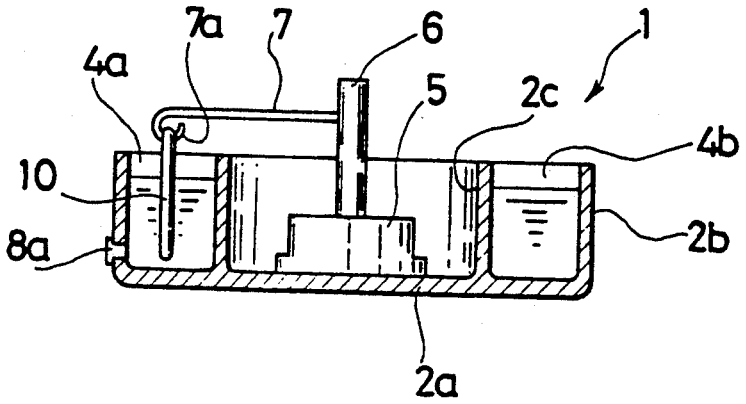
FIG. 2 is a cross-sectional view taken along line II—II of FIG. 1.
Figure 3:
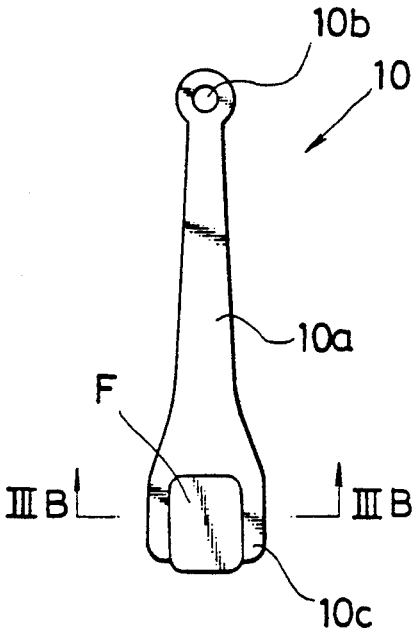
FIG. 3(A) is a side view of a holder.
FIG. 3(B) is a cross-sectional view taken along line IIIB—IIIB of FIG. 3(A)
Figure 3:
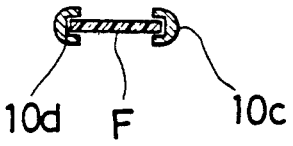
Figure 4:
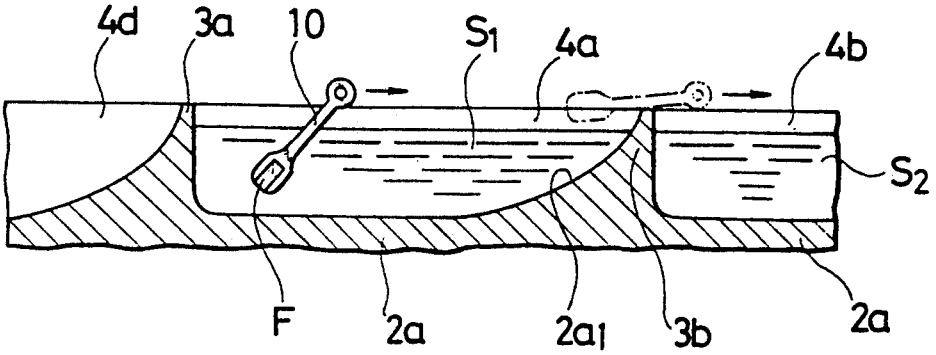
FIG. 4 is an operation schematic of the developing machine shown in FIGS. 1 and 2.
Figure 15:
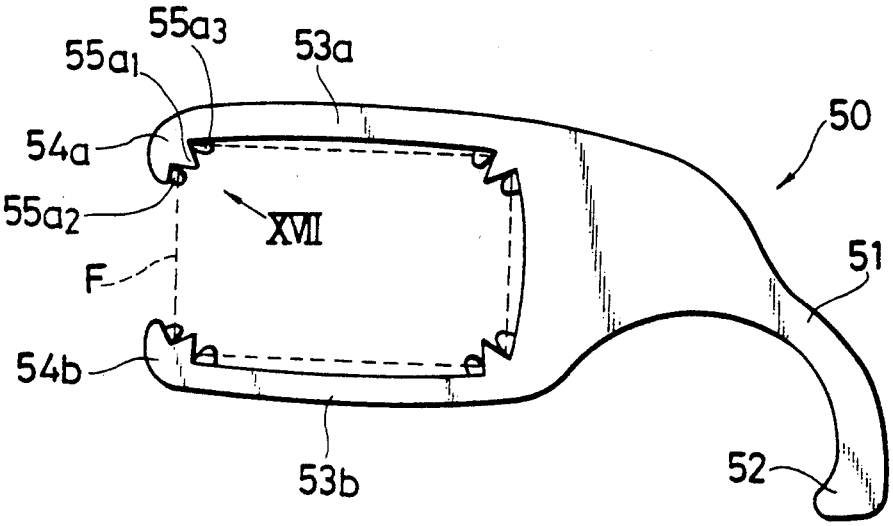
FIG. 15 is a plan view of a film holder suitable for use in the developing machine of FIGS. 5 and 6.
Figure 16A:
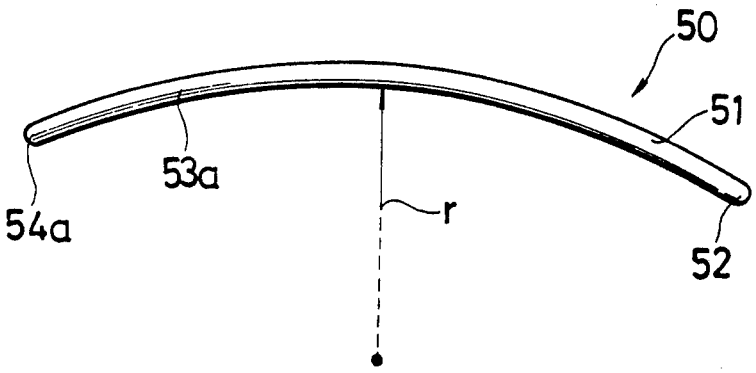
FIG. 16(A) is a side view of the film holder of FIG. 15.
Figure 16B:
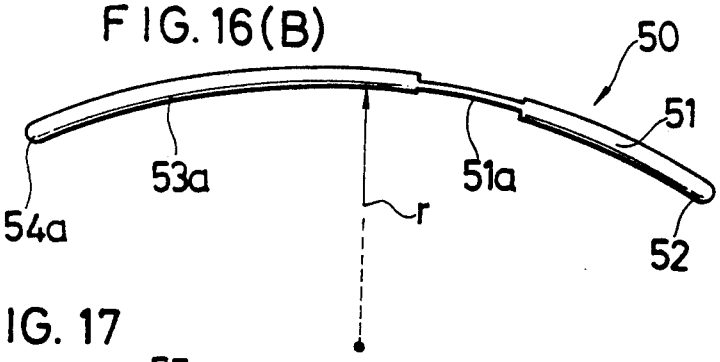
FIG. 16(B) is similar to FIG. 16 (A) but illustrates another example of film holder.
Figure 17:
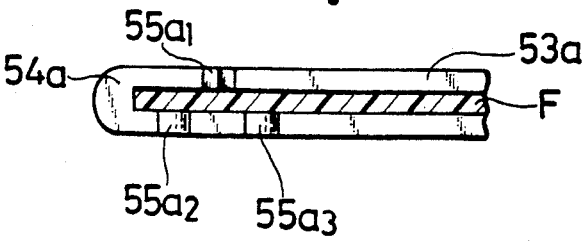
FIG. 17 is a side view of the film holder of FIG. 15 as viewed in the direction of arrow XVII in FIG. 15.

A description will next be made of film holders suitable for use in the developing machine according to the first embodiment. These film holders correspond to the conventional holder 10 depicted in FIGS. 3(A) and 3(B). In FIGS. 15, 16(A), 16(B) and 17, numeral 50 indicates the film holders. There are also illustrated a stem portion 51 of each film holder, a hook portion 52 formed at one end of the stem portion 51, and film-holding portions 53*a*,53*b* extending out in the form of bifurcated branches from the other end of the stem portion 51. Designated at symbols 54*a*,54*b* are free end portions of the individual film-holding portions 53*a*,53*b*. Incidentally, the stem portion 51 is inclined relative to the film-holding portions 53*a*,53*b* and protrudes out by a predetermined distance beyond an imaginary longitudinal axis extending through either one of the film-holding portions 53*a*,53*b* (the film-holding portion 53*b* in the illustrated example). Both the film holders 50 are bent as a whole as illustrated in FIGS. 16(A) and 16(B). Their radius r of curvature is the same as that of the housing 31 and tank 36. Film-holding claws 55$a_1$,55$a_2$,55$a_3$ are formed at the free end 54*a* as shown in FIGS. 15 and 17. By these claws, the film F is held on the film holder 50. Similar film-holding claws are formed at the free end 54*b* and also at base portions of the respective film-holding portions 53*a*,53*b*. Symbol 51*a* which appears in FIG. 16(B) is a thin-walled portion formed between the stem portion 51 and the film-holding portions 53*a*,53*b*. Where the width W (see FIG. 9) of the tank 36 is narrow and/or the radius of curvature of each tank 36 is small, movement of the film holder 50 in the tank 36 may press the film holder against an inner wall of the tank 36 so that smooth movement of the film holder 50 may be prevented. The thin-walled portion 51*a* is formed to avoid such a trouble. The film holder 50 has flexibility as its thickness is small at the thin-walled portion 51*a*. Even when the film holder 50 is pressed against the inner wall of the tank 36, the film holder 50 is allowed to flex at the thin-walled portion 51*a* so that movement of the film holder 50 is not prevented.

The film holder 50 with the film F held thereon is then placed in the film-placing opening 24 shown in FIGS. 5 and 6 and its hook portion 52 engages the arm 35 which is connected to the motor shaft 34 and is being rotated. As a result, the film holder 50 advances through the tanks 36 so that the film F held thereon is developed. At the film-holder-detaching portion 45 shown in FIG. 6, the engagement between the film holder and the arm 35 is released at the film holder take-out portion 45 illustrated in FIG. 6. The film holder is then taken out of the box 43.

Referring next to FIGS. 18 to 21, a description will hereinafter be made of the mechanism for the engagement/disengagement between the film holder 50 and the arm 35.

Figure 18:
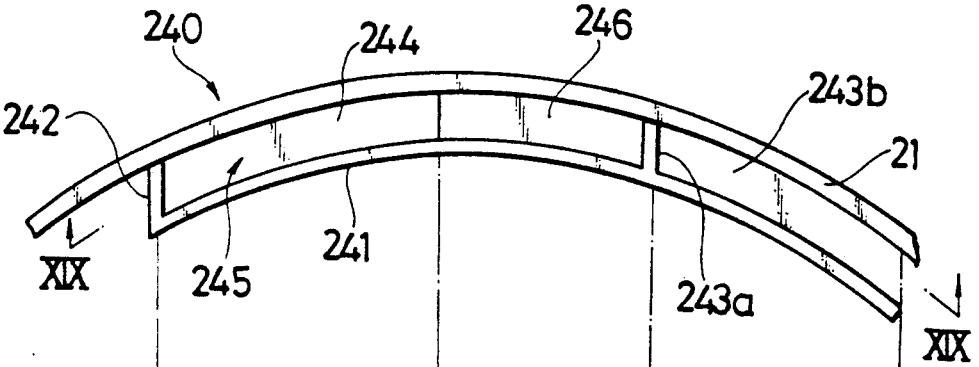
FIG. 18 is a plan view of a film-holder-inserting box provided in the developing machine of FIG. 5 and 6.
Figure 19:
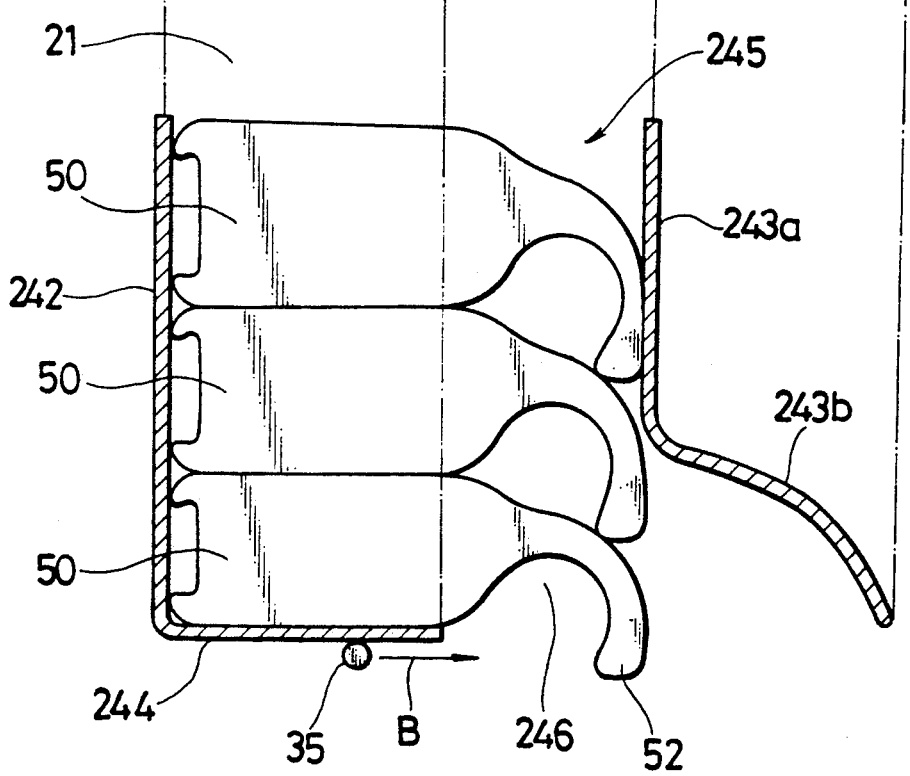
FIG. 19 is a cross-sectional view taken along line XIX—XIX of FIG. 18.
Figure 20:
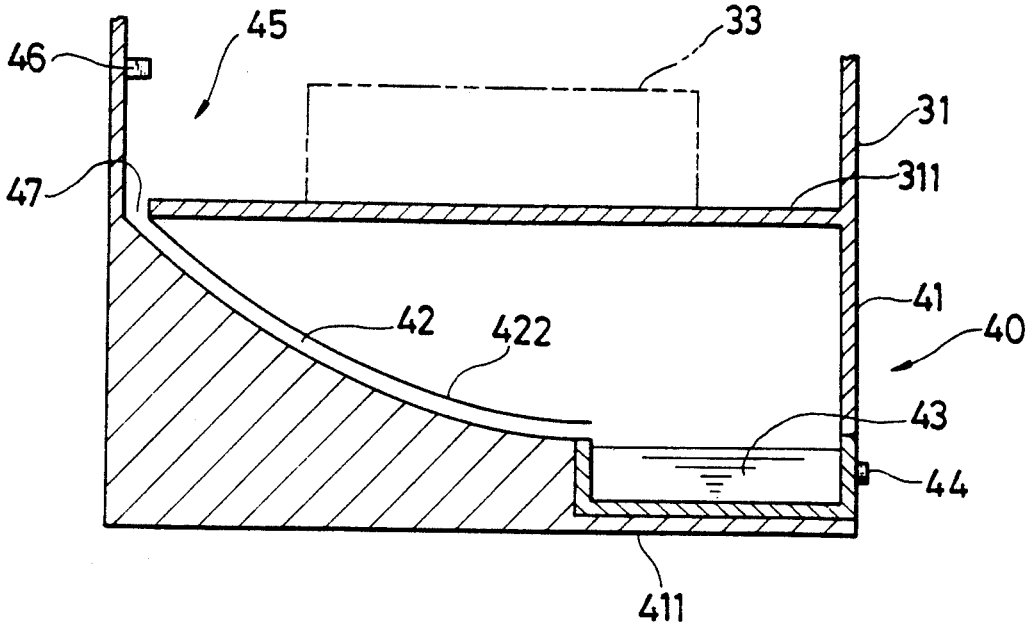
FIG. 20 is a cross-sectional view of a film-holder-detaching portion provided in the developing machine of FIGS. 5 and 6.
Figure 21:
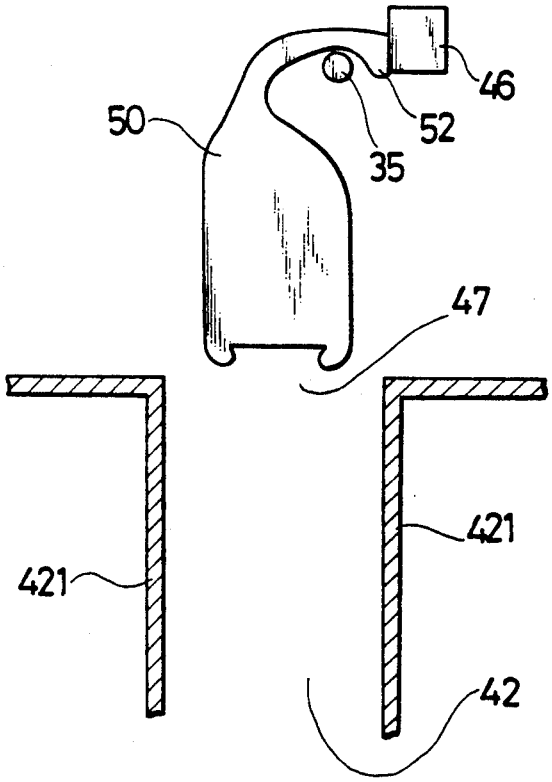
FIG. 21 is an operation schematic of the film-holder-detaching portion depicted in FIG. 20.

A film-holder-inserting box shown in FIGS. 18 and 19 forms the film-holder-placing opening 24 of the film-mounting and placing portion 20 illustrated in FIGS. 5 and 6, while a film-holder-detaching portion depicted in FIGS. 20 and 21 corresponding to the film-holder-detaching portion 45 shown in FIG. 6.

The construction of the film-holder-inserting box will be described first with reference to FIGS. 18 and 19, in which numeral 240 indicates the film-holder-inserting box 240. The film-holder-inserting box 240 is constructed of the housing 21 as one of side walls, a side wall 241 as the other side wall, said side wall opposing the housing 21 and having the same curved shape as the housing 21, a wall 242 connecting the side wall 241 and the housing 21 to each other, guide walls 243*a*,243*b*, a bottom wall 244, a film-holder-playing opening 245 formed in an upper part, and a cut-off portion 264 formed by cutting off the bottom wall 244. In FIG. 19 , designated at numeral 35 is an arm which can undergo similar rotation as that depicted in FIGS. 5 and 6, and arrow B indicates the direction of movement of the arm 35. Numeral 50 indicates the film holder shown in FIGS. 15–17. In the illustrated embodiment, three film holders are shown in a state stacked one over another.

The construction of the film-holder-detaching portion will next be described with reference to FIGS. 20 and 212*a*, in which elements identical to those shown in FIGS. 5 and 6 are identified by like numerals or symbols. The film-holder-detaching portion 45 is constructed of the detaching portion 46 provided on the housing 31 of the development processing portion 30, the opening 47 formed through the bottom wall 311 of the housing 31 at a location underneath the detaching portion 46, and the transfer path 42 provided inside the housing 41 of the take-out portion 40 and communicating the opening 47 to the box 43. Designated at numeral 421 is guide walls arranged on opposite sides of the transfer path 42, while designated at numeral 422 is a light-shielding plate covering the transfer path 42. The detaching projection 46 is positioned at a predetermined point in the range of transfer of the processing. film holder after completion of the development processing.

Operation of the dental X-ray film developing machine according to the first embodiment of the present invention will next be described together with operation of the development processing. Upon development processing, the developer tank 36 and the fixer tank 36 are arranged along the housing 31 as illustrated in FIG.

6. Arrangement and positioning of the respective tanks 36 and peeling-off of the cover films 361 have already been described above. In this state, an exposed dental X-ray film pack is inserted in the housing 21 of the film-mounting and placing portion 20. An operator inserts both hands into the housing through the two holes 22 formed in the housing 21 (an arm cover for shielding light is provided between each hole 22 and its corresponding hand). The X-ray film F is taken out of the dental X-ray film pack and, using the film mounting stage 23, the X-ray film F is mounted on the film holder 50. The film holder with the film F mounted thereon is placed in the direction indicated in FIG. 19 into the film-holder-inserting box 240 through the film-holder-placing opening 245. The film holder 50 so placed is supported on the bottom wall 244 so that the hook portion 52 downwardly protrudes from the cut-off portion 246 and is located in a path of the arm 35. Incidentally, in the case illustrated in FIG. 19, three film holders 50 are inserted one over another.

When the motor 32 is driven and the arm 35 progressively advances in direction indicated by arrow B in FIG. 19, the arm 35 is brought into engagement with the hook portion 52 of the film holder 50, said hook portion 52 protruding in the advancing path of the arm 35, so that the arm 35 continues its advancing movement while dragging the film holder 50. This movement of the film holder 50 takes place while slightly pushing the overlying, other film holders 50 upwardly. As soon as the free end **54*b* of the film-holding portion 53*b* separates from the bottom wall 244, the film holder 50 turns counterclockwise about the arm 35 whereby the film holder 50 is brought into a state such that the film holder 50 is suspended at the hook portion 52 from the arm 35. As the arm 35 advances, the film holder 50 passes through the individual tanks 36 as in the conventional developing machines so that development and fixing are carried out successively. Since the film holder 50 is curved as described above, it can smoothly pass through the tanks 36 without any problem despite of the curved configuration of the tanks even if the tanks 36 has a small width. After the film holder 50 has been pulled out of the film-holder-inserting box 240 by the arm 35 as described above, the next film holder 50 which was sitting on the film holder 50 so pulled out is positioned on the bottom wall 244 and awaits arrival of the next arm 35**.

When the development processing has been completed and the film holder 50 has reached the film-holder-detaching portion 45, the hook portion 52 is brought into contact with the detaching projection 46 fixed on the housing 31 as shown in FIG. 21. As the arm 35 advances further, the engagement between the film holder 50 and the arm 35 is released because the hook portion 52 is maintained in contact with the detaching projection 46. Accordingly, the film holder 50 drops by its own weight and slides down into the box 43 through the opening 47 and the transfer path 42 (see FIG. 20). Filling of water in the box 43 permits omission of the washing tank. The box 43 is drawn out and the film holder 50 is taken out. The X-ray film F is then removed from the film holder 50. The development processing of the X-ray film F has now been completed so that an X-ray picture of a tooth is shown there.

It is to be noted that inclination of the step portion of the film holder is not essential. When the bottom wall of the film-holder-inserting box is constructed aslant, the hook portion is still allowed to extend into the path of movement of the arm.

As has been described above, the present embodiment permits automated attachment and detachment of each film holder to and from the rotating arm. This has made it possible to save the labor and time required for the attachment and detachment, and has also facilitated the handling substantially. Since the attachment and detachment of each film holder can be conducted automatically as described above, it is no longer required to stop rotation of the arm for the purpose of such detachment and attachment so that the work efficiency of development processing can be improved. Further, the curved configurations of the tanks and film holders allow to reduce the overall dimensions and the use of the removable tanks facilitates replacement of the processing solutions. Furthermore, the opening of each tank is closed by a cover film so that the tank itself can be handled with ease and its processing solution can be protected from deterioration.

In the above-described embodiment, the arm 35 is fixed on the shaft 34 of the motor 32 and the arm 35 engages the hook portion 52 of the film holder 50. The engagement of the arm 35 and the film holder 50 is however not limited to the construction described above but can be achieved by other constructions. For example, the arm 35 can be constructed in such a way that the arm can selectively extend or retreat in the radial direction of the cylindrical housing 31, the arm 35 is driven with its free end fitted in a through-hole formed in one end of the film holder 50 during development processing, and the free end of the arm 35 is released from the through-hole after completion of the development processing. This construction will hereinafter be described. Firstly, the shape of each film holder useful for the above construction will be described with reference to FIGS. 22 and 23, and the structure of a film-holder-inserting box also useful in the above construction will be described with reference to FIG. 24 and 25. Thereafter, a detaching mechanism for the arm 35 and the film holder 50 will be described with reference to FIGS. 26 and 27, and the structure of a releasing portion for the arm 35 will be described with reference to FIG. 28.

Figure 22:
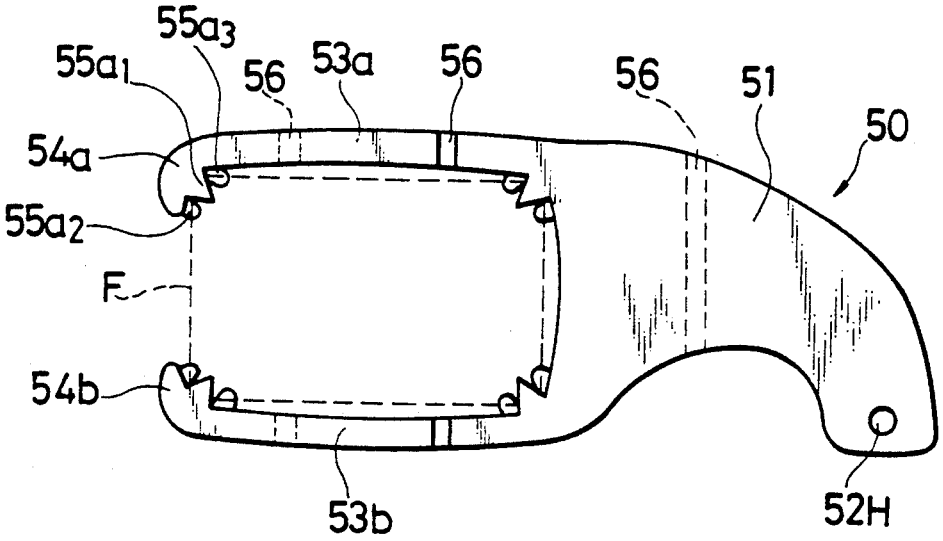
FIG. 22 is a plan view of a of film holder suitable for use in a dental X-ray film developing machine according to a second embodiment of the present invention.
Figure 23:
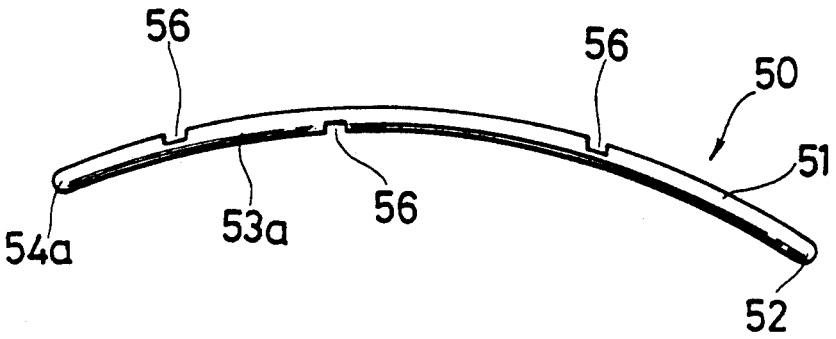
FIG. 23 is a side view of the film holder of FIG. 22.

Referring now to FIGS. 22 and 23, elements either identical or equivalent to those shown in FIGS. 15, 16(A) and/or 16(B) are identified by like numerals or symbols and their description is omitted herein. Numeral 50 indicates a film holder. Designated at symbol 52H is a through-hole formed in a free end of a stem portion 51. There are also shown grooves 56 formed in film-holding portions **53*a*,53*b* and a stem portion 51, respectively. Similarly to FIG. 16(B), depending on the width of each tank and the length of its radius of curvature, a thin-walled portion can be formed in the stem portion 51 on the side of the film-holding portions 53*a*,53*b* although this thin-walled portion is omitted in the drawings. The film holder 50 with a film F mounted thereon is placed in the above-described film-placing opening 24. The arm 35 which is rotating together with the motor shaft 34 enters the through-hole 52H of the film holder 50, whereby the film holder 50 is caused to pass through the individual tanks 36 while being dragged by the arm 35. As a result, the film F is subjected to development processing. Finally, the arm 35 is pulled out at the film-holder-detaching portion 45 and the film holder 50 is then taken out of the box 43**.

Figure 24:
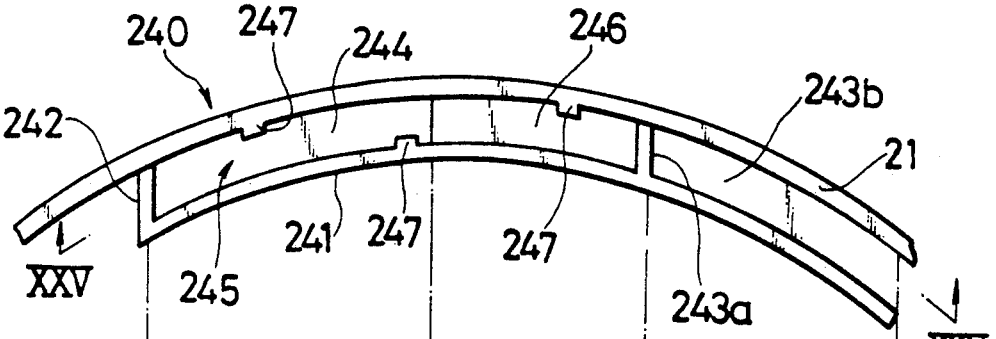
FIG. 24 is a plan view of a film-holder-inserting box provided in the developing machine according to the second embodiment of the present invention.
Figure 25:
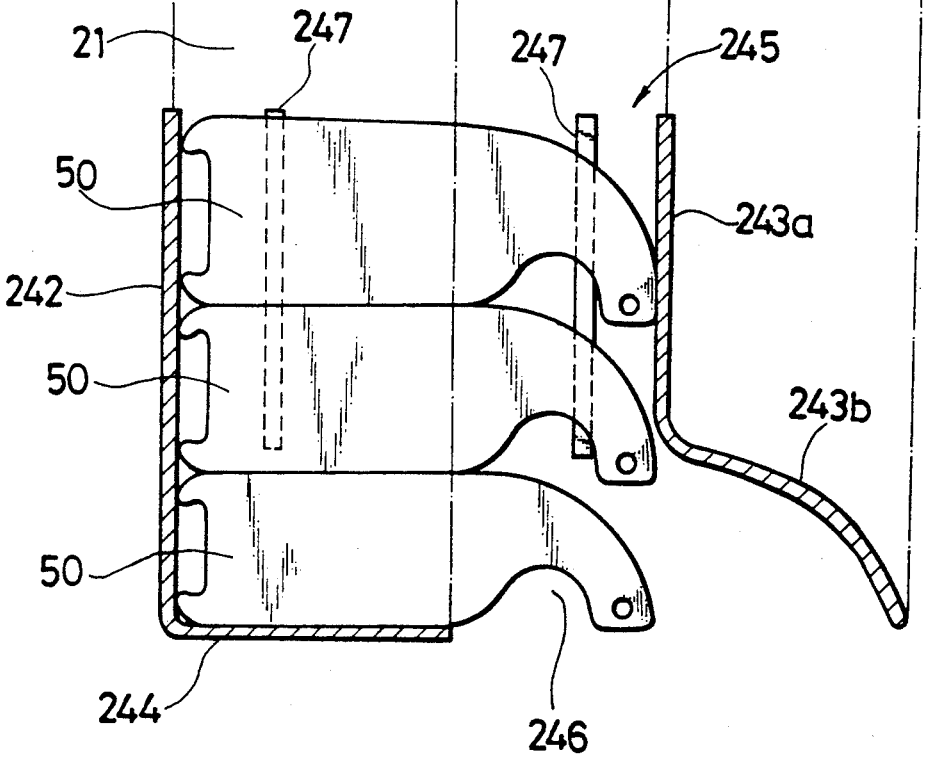
FIG. 25 is a cross-sectional view taken along line XXV—XXV of FIG. 24.

A description will next be made of the film-holder-inserting box into which the film holder 50 is inserted through the film-placing opening 24 to place the film-holder 50 therein. Referring to FIGS. 24 and 25, elements either identical or equivalent to those shown in FIGS. 18 and 19 are indicated by like numerals or symbols and their description is omitted herein. Designated at numeral 240 is the film-holder-inserting box. Designated at numerals 247 are ribs on which the grooves 56 of the film holder 50 shown in FIG. 23 are fitted. In the embodiment depicted in FIG. 25, three film holders 50 are stacked one over another. In this case, the grooves 56 of only the lowermost film holder 50 are not fitted on the ribs 247. Further, the through-hole 25H of the lowermost film holder 50 is exposed into the interior of the housing **32*a*1**.

Figure 26:
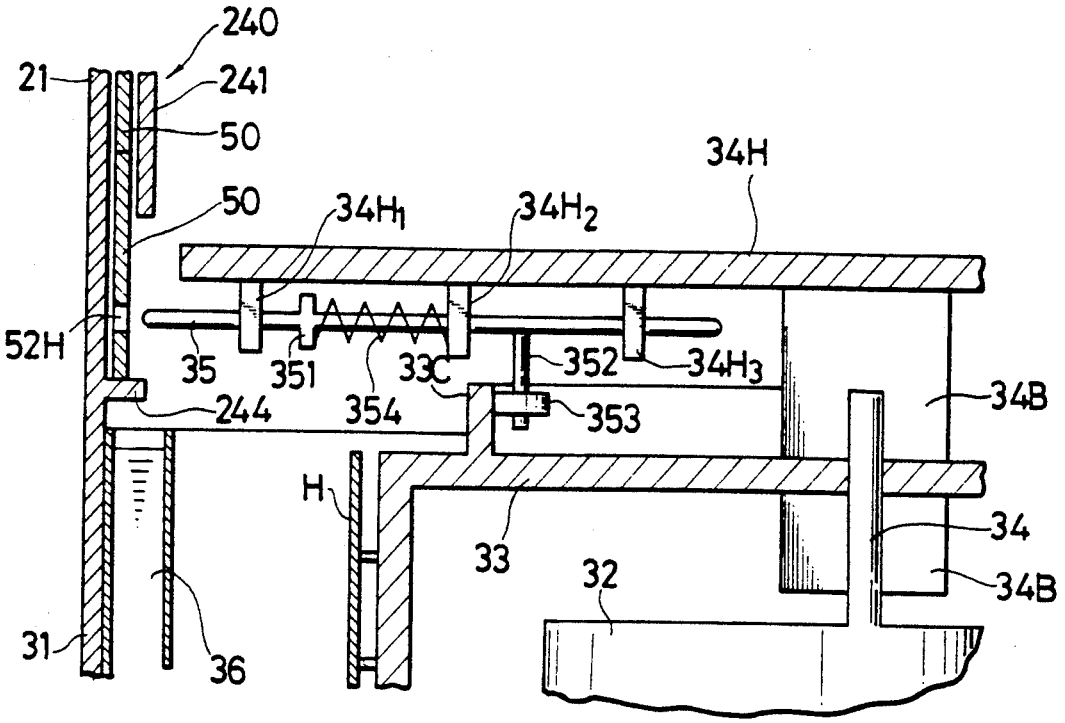
FIG. 26 is a fragmentary cross-sectional view of the developing machine according to the second embodiment of the present invention.
Figure 27:
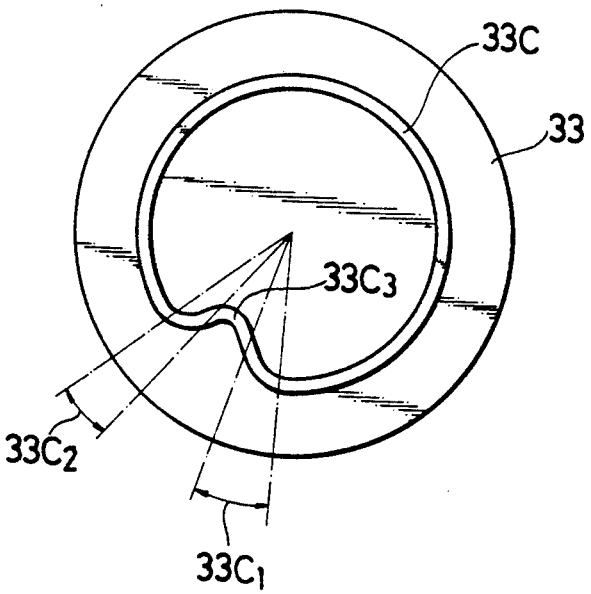
FIG. 27 is a plan view of a cam shown in FIG. 26.

With reference to FIGS. 26 and 27, a description will now be made of the mechanism for inserting the arm 35 into the through-hole 52H of the film holder 50 and pulling it out. Elements either identical or equivalent to those shown in FIGS. 5–19 are indicated by like numerals or symbols and their description is omitted herein. Symbol 34B indicates a bearing for the shaft 34 of the motor 32. An arm support 34H is constructed in the form of a disk. The arm support 34H is located above the motor cover 33 and is fixed on the shaft 34 of the motor 32, whereby the arm support 34H rotates together with the shaft 34. Designated at symbols $34H_1$,$34H_2$,$34H_3$ are pendants which support the arm 35 underneath the arm support 34H. These pendants $34H_1$, $34H_2$,$34H_3$ are arranged at radial intervals as viewed in the direction of the radius of the arm support 34H. Although not shown in the drawings, plural set of such pendants are provided at predetermined angular intervals. Each of the pendants $34H_1$,$34H_2$,$34H_3$ supports the arm 35 movably in the direction of the radius of the arm support 34H.

There are also illustrated a spring seat 351 formed on the arm 35, a rod 352 provided on the arm 35, a roller 353 attached to a free end portion of the rod 352, and a spring 354 arranged between the spring seat 351 and the pendant $34H_2$. The rod 352 and the roller 353 together make up a cam follower.

Symbol 33C indicates a cam formed on the upper surface of the motor cover 33. The configuration (contour) of the cam 33C is illustrated in FIG. 27. The cam 33C includes an arm-retreating region $33C_1$, an arm-extending region $33C_2$ and a maximum spring-compressing region $33C_3$.

Operation of this embodiment will next be described. When the motor 32 rotates, the arm support 34H also rotates. Thus, the arm 35 supported on the arm support 34H also rotates. As a result of the rotation of the arm 35, the roller 353 also rotates and moves while being maintained in contact with the cam 33C under the biasing force of the spring 354. Assume that the roller 353 is now located in the region $33C_3$ of the cam 33C. Since the roller 353 has moved toward the shaft 34 by compressing the spring 354, the arm 35 is located at the most retreated position (i.e., pulled-in position). As the rotation proceeds further, the roller 353 enters the region $33C_2$ of the cam 33C so that the roller 353 moves away from the shaft 34. As a consequence, the arm 35 is allowed to extend leftwards as viewed in FIG. 26. The region $33C_2$ is set such that, when the arm 35 is extended as described above, the position of the free end of the arm 35 exactly coincides with the position of the through-hole 52H of the lowermost film holder 50 placed in the film-holder-inserting box 240.

As a result of insertion of the arm 35 into the through-hole **52H2*a*, the film holder 50 is brought into engagement with the arm 35 and is moved together with the arm 35. As the arm 35 advances, the film holder 50 passes through the processing solutions in the individual tanks as in the conventional machine so that developing, fixing and washing are conducted. Since the film holder 50 is curved as described above, the film holder 50 can smoothly pass through the tanks 36 without problem despite of their curved configuration even when these tanks 36 has a narrow width. The film holders 50 stacked in the film-holder-inserting box 240 successively move downwards as the lowermost film holder 50 is brought into engagement with the arm 35 and is pulled out. Even when the lowermost film holder 50 is pulled out, the remaining film holders 50 however do not tilt owing to the fitting of the grooves 56 on the ribs 247. As a result, the remaining film holders 50 can also be pulled out smoothly. After the lowermost film holder 50 has been pulled out, the next film holder awaits arrival of the next arm 35**.

When the development processing has been completed and the roller 353 has entered the region $33C_1$ of the cam 33C, the roller 353 again moves toward the shaft 34 and, as a consequence, the arm 35 also moves rightwards as viewed in FIG. 26. As a result, the arm 35 is separated from the through-hole 52H of the film holder 50 so that the film holder 50 drops. The detaching mechanism for the film holder 50 will next be described with reference to FIG. 28.

Figure 28:
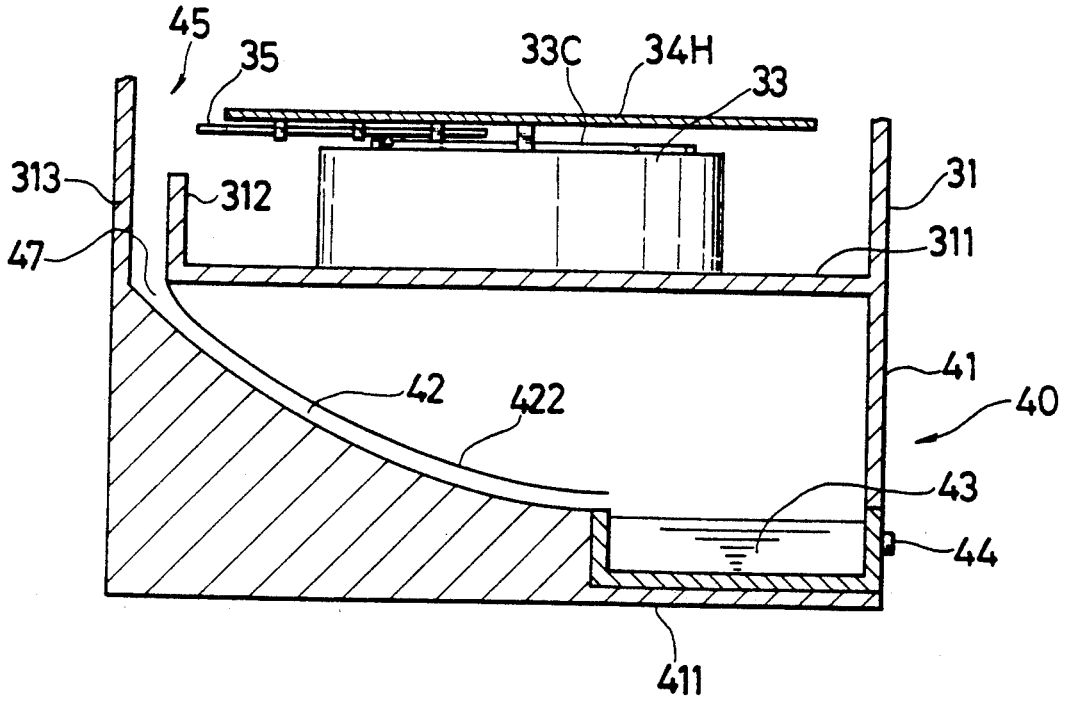
FIG. 28 is a cross-sectional view of a film-holder-detaching portion illustrated in FIG. 26.

In FIG. 28, elements identical to those depicted in FIGS. 5, 6, 26 and 27 are identified by like numerals or symbols and their description is omitted herein. In FIG. 28, there are shown the bottom wall 311 of the housing 31, a detaching wall 312 extending upright from a part of the bottom wall 311, a space 313 defined between the detaching wall 312 and the housing 31, the bottom wall 411 of the housing **42*a*1, and the light-shielding plate 422 covering the transfer path 42**.

The detaching mechanism is constructed such that, when the development processing has been completed and the roller 353 has entered the region $33C_1$ of the cam 33C, the film holder 50 kept in engagement With the arm 35 is located inside the space 13. When the arm moves rightwards in this state as described above, the film holder 50 is stopped by the detaching wall 312 and the arm 35 is pulled out of the through-hole 52H. As a result, the film holder 50 drops by its weight and slides down into the box 43 through the through-hole 52H and the transfer path 42. Filling of a washing liquid in the box 43 permits omission of the washing tank. The box 43 is drawn out and the film holder 50 is taken out. The X-ray film F is then removed from the film holder 50. The development processing of the X-ray film F has now been completed so that an X-ray picture of a tooth is shown there.

In the description of the second embodiment described above, the arm support was formed in a disk-like shape by way of example. It may be formed in any shape as long as the arm can be supported. For example, the arm support may be rods fixed on the shaft of the motor, the number of said rods being equal to the number of arms. It is not essential to form each film folder in such a curved configuration. It is not absolutely necessary to provide the cam on the motor cover. An additional plate can be provided to support the cam. Further, it is not essential to use the roller as the member maintained in contact with the cam. Any suitable contact member (i.e., cam follower) can be used.

The dental X-ray film developing machine according to the second embodiment can bring about the same advantages as the developing machine of the first embodiment and, in addition, can also bring about the advantage that the engagement between the arm and the film holder can be ensured further.

In the above description of the first and second embodiments, three film holders were placed one over another in the film-holder-inserting box, by way of example. The film-holder-inserting box can however be formed to place only one film holder or, depending on the height of the housing 32a1, four or more film holders. Each tank was formed with substantially the same radius of curvature as the tank, by way of example. The configuration of each tank is however not necessary limited to it. Each tank may have a straight portion as long as its width permits.

What is claimed is:

1. A dental X-ray film developing machine having a cylindrical housing, a motor fixed on the housing, an arm for being driven in a plane by the motor, and a film holder for being brought into detachable engagement with the arm while said arm is in said plane whereby development processing of a film mounted on the film holder is conducted while the film holder makes a full turn within the housing, comprising:

a support for supporting thereon the arm movably in a radial direction of the cylindrical housing, said support being rotatable integrally with a rotary shaft of the motor, and said arm being equipped with a cam follower movable in a biased state and in contact with a cam which controls movement of the arm;

a plurality of tanks removably arranged along a peripheral wall of the housing, one of said tanks containing a developer, and another one of said tanks containing a final processing solution;

a film-holder-inserting portion located before the developer-containing tank relative to the turning direction of the arm so that a through-hole bored at a desired location of the film holder with the film mounted thereon can be positioned at a point where the film holder can be brought into engagement with the arm which is being driven; and a film-holder-detaching means for detaching the film holder from the arm, said film-holder-detaching means being located after the final-processing-solution-containing tank relative to the turning direction of the arm.

2. The machine of claim 1, wherein a side wall of each tank, said side wall opposing the peripheral wall of the housing when arranged in the developing machine, is formed with a radius of curvature conforming with that of the peripheral wall of the housing, and the width of tank is much smaller than the depth of the tank.

3. The machine of claim 2, wherein each tank has an opening which is covered by a removable film.

4. The machine of claim 2, wherein each tank is attached to the housing by means of a tank-positioning structure formed on a side of the housing.

5. The machine of claim 4, wherein the tank-positioning structure comprises at least one lug formed on the tank and a like number of grooves formed in the housing, whereby the lug can be fitted in the groove.

6. The machine of claim 1, wherein the film-holder-inserting portion is provided along the peripheral wall of the housing, defines an opening for inserting the film holder therethrough, and has a bottom wall for supporting the film holder and a cut-off portion; and, when the film holder is supported on the bottom wall, the cut-off portion allows one end of the film holder to locate at the point where the one end of the film holder can engage the arm and also permits release of the film holder from the film-holder-inserting portion.

7. The machine of claim 6, wherein the film-holder-inserting portion has a vertical depth sufficient to permit insertion of at least one of the film holder.

8. The machine of claim 1, wherein the film holder comprises a stem portion having two ends, the through hole formed in one end of the stem portion and engageable with the arm, and a film-mounting portion formed at the other end of the stem portion and permitting fitted insertion of the film therein.

9. The machine of claim 8, wherein the stem portion has substantially the same curvature as the peripheral wall of the housing.

10. The machine of claim 8, wherein at least one thin-walled portion is formed in the stem portion on a side of the film-mounting portion.

11. The machine of claim 8, wherein the film-mounting portion is bifurcated to define branches between which the film is fitted.

12. The machine of claim 11, wherein the cam is formed such that the arm is extended at a first position where the arm engages the through-hole of the film holder and is retreated at a second position where the arm is disengaged from the through-hole of the film holder.

13. The machine of claim 12, wherein the first position is the position that—when the film holder is mounted on a bottom wall of the film-holder-inserting portion, said bottom wall being an internal wall of the housing—a free end of the arm faces the through-hole.

14. The machine of claim 1, wherein the film-holder-detaching means comprises a region of a cam, said region being capable of retreating the arm, and a transfer path for guiding to a film holder take-out opening the film holder dropped by a retreat of the arm.

* * * * *